United States Patent [19]

Ishida

[11] 4,383,714

[45] May 17, 1983

[54] ROCKING MOVABLE CHAIR

[75] Inventor: Kunio Ishida, Yokohama, Japan

[73] Assignee: Tokico Ltd., Kanagawa, Japan

[21] Appl. No.: 176,243

[22] Filed: Aug. 7, 1980

[30] Foreign Application Priority Data

Aug. 20, 1979 [JP] Japan ..... 54-105663
Aug. 20, 1979 [JP] Japan ..... 54-105664
Aug. 20, 1979 [JP] Japan ..... 54-105665

[51] Int. Cl.[3] ..... A47C 1/02

[52] U.S. Cl. ..... 297/325; 297/68; 297/261; 297/327

[58] Field of Search ..... 297/327, 325, 328, 330, 297/68, 71, 261, 262, 345, 258

[56] References Cited

U.S. PATENT DOCUMENTS

| | | | |
|---|---|---|---|
| 1,837,911 | 12/1931 | Lillibridge | 297/261 |
| 2,313,023 | 3/1943 | Ruegger | 297/269 X |
| 2,448,325 | 8/1948 | Poorman, Jr. | 297/258 X |
| 2,952,302 | 9/1960 | Mittlieder | 297/327 |
| 3,837,704 | 9/1974 | Bauer | 297/345 |
| 4,076,308 | 2/1978 | Slabon | 297/327 |
| 4,101,168 | 7/1978 | Ferro | 297/330 X |

FOREIGN PATENT DOCUMENTS

| | | | |
|---|---|---|---|
| 2735583 | 2/1979 | Fed. Rep. of Germany | 297/325 |
| 2307672 | 11/1976 | France | 297/325 |
| 312213 | 7/1969 | Sweden | 297/261 |

*Primary Examiner*—James T. McCall
*Attorney, Agent, or Firm*—Wenderoth, Lind & Ponack

[57] ABSTRACT

A rockingly movable chair includes a leg portion, a seat portion mounted on the leg portion and a circular arc surface provided on either of the leg portion or the seat portion for cooperating with an element which is provided on the other of the leg portion or the seat portion and which is displaceable along the circular arc surface so that the seat portion can rockingly move relative to the leg portion. A spring is provided between the leg portion and the seat portion to bias the seat portion with respect to the seat portion in one direction during the rocking movement. A locking device is provided to lock the rocking movement at a desired position.

9 Claims, 12 Drawing Figures

ROCKING MOVABLE CHAIR

BACKGROUND OF THE INVENTION

This invention relates to rockingly movable chairs particularly adapted for use in office work.

Conventional chairs used in office work comprise a seat horizontally mounted on a leg portion and a tiltable back which is normally biassed to a generally vertical position by a spring. The user of the chair can temporarily change his attitude by leaning on the back to relieve his fatigue. However, it has been difficult to maintain such attitude without forcibly leaning on the back. Further, the angle between the upper half and the lower half of the body of the user will change in changing the tilting angle of the back, which is not necessarily suitable for relieving his fatigue even though the back of the chair is locked at a desired tilting angle. It is preferable to maintain the angle between the upper and lower halves of the body at a predetermined range for minimizing fatigue and maximizing the efficiency of office work. Further, it has sometimes been required to maintain the angle between the upper and lower halves of the body at a predetermined range with the tilting angle of the seat or the back of the chair with respect to the horizontal surface being adjustable in some types of the work.

Further, it is publicly known that the fatigue can quickly be relieved by rockingly moving the chair back and forth.

Conventional chairs used in office work cannot satisfy the requirements aforementioned.

SUMMARY OF THE INVENTION

The present invention aims to satisfy the requirements aforementioned and, according to the invention, there is provided a rockingly movable chair comprising a leg portion, a seat portion supported on the leg portion, a circular arc surface provided on either of the leg portion or the seat portion, an element provided on the other of the leg portion and the seat portion and being displaceable along the circular arc surface so that the seat portion can rockingly move on the leg portion, a spring provided between the leg portion and the seat portion and biassing the seat portion with respect to the leg portion in one direction during the rocking movement thereof, and a locking device for locking the rocking movement of the seat portion.

Preferably, the spring is a gas spring and another gas spring is provided in the leg portion to adjustably change the height thereof.

BRIEF DESCRIPTION OF THE DRAWINGS

The invention will hereinafter be explained in detail in conjunction with the accompanying drawings, exemplifying some preferred embodiments of the invention, in which.

DETAILED DESCRIPTION OF THE PREFERRED EMBODIMENTS

Figure 1:
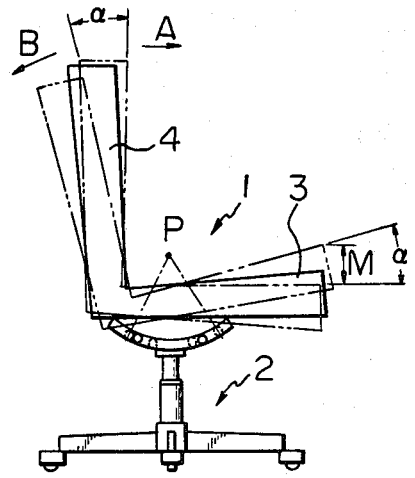
FIG. 1 is an explanatory view of a rockingly movable chair according to the invention.
Figure 2:
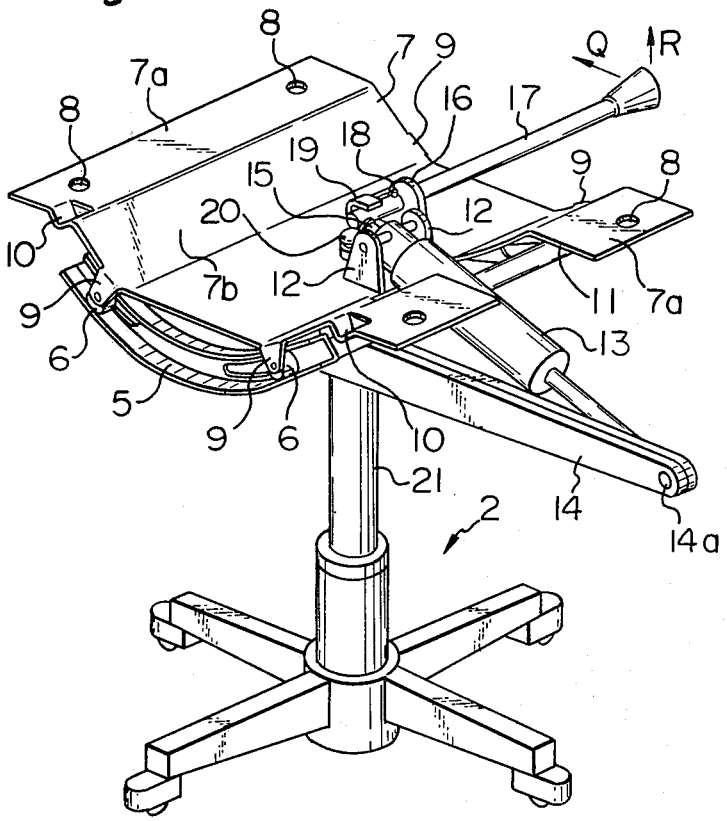
FIG. 2 is a perspective view of the chair of FIG. 1 with the seat and the back thereof being removed.
Figure 3:
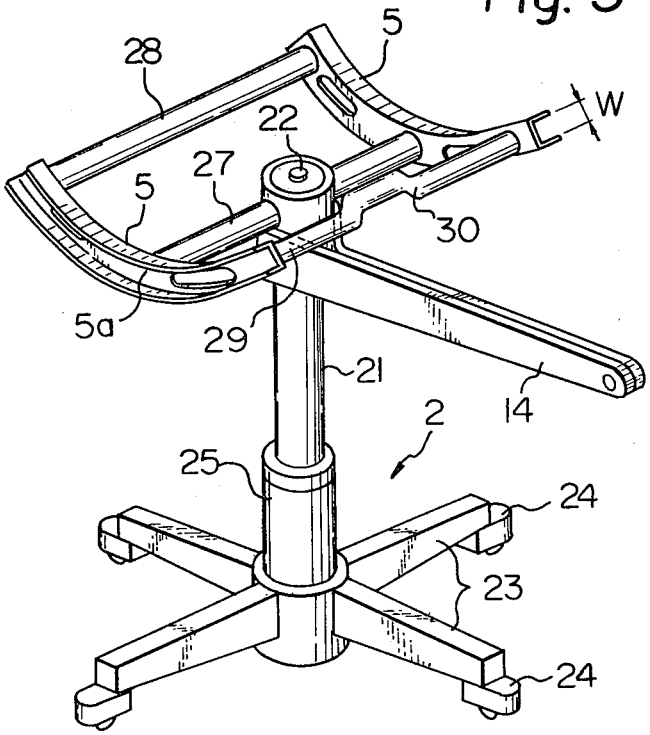
FIG. 3 is a perspective view of the leg portion of the chair of FIG. 1.

The rockingly movable chair shown in FIGS. 1–3 comprises a seat portion 1 and a leg portion 2, and the seat portion 1 consisting of a seat 3 and a back 4 can rockingly move with respect to the leg portion 2. As shown in FIG. 1, when the seat 3 is tilted in the counterclockwise direction by an angle $\alpha$, the back 4 also tilts in the counterclockwise direction or the arrow B direction by the angle $\alpha$.

The seat portion 1 has a supporting frame 7 which can rockingly move along circular arc shaped rails 5 secured to the leg portion 2. Rollers 6 are rotatably mounted on the supporting frame 7 and engage with rails 5. There are provided openings 8, for passing therethrough bolts (not shown) securing the supporting frame 7 to the main body of the seat portion in flange portions *7a*, of the supporting frame 7. In the embodiment, the intermediate portion *7b* defined between the flange portions *7a* and *7a* projects in the downward direction. On the opposite side edges of the supporting frame 7, there are provided downwardly projecting brackets 9 for respectively mounting the rollers 6. Thus, when the rollers 6 rotatably move along the rails 5, the supporting frame 7 rockingly moves with respect to the leg portion 2. For restricting the rocking movement of the supporting frame 7 there are provided stops 10 in the flange portions *7a* to engage with corresponding ends of the rails 5 at the ends of the rocking movement of the supporting frame 7. The stops 10 may be replaced by suitable members secured to the rails to engage with the rollers.

A cut-out portion 11 is formed in one of the flanges *7a*, and a pair of upwardly projecting brackets 12 are formed on the intermediate portion *7b* of the supporting frame 7 to pivotally mount therebetween a gas spring 13. One end of the gas spring 13 is pivotally mounted on a generally horizontally extending supporting arm 14 which is secured to the leg portion 2. A lock valve 15 is mounted on the other end of the gas spring 13 for normally locking the extending or contracting movement of the gas spring. When the lock valve 15 is actuated, the gas spring 15 tends to extend or contract according to specific characteristics of the gas spring so that the supporting frame will tilt in one direction until either of the stops 10 engages with one end of the rail 5. However, the force of the gas spring 13 is preferably not so large that the person seated on the chair can easily rock the chair back and forth or change the tilting angle of the chair. When the lock valve is deactivated, the extending or contracting movement of the gas spring is prevented and the chair maintains its angular position.

A lever 17 is provided for actuating the lock valve 15. The lever 17 is rockingly movably mounted on a bracket 16 which is secured on the supporting frame 7. In embodiment, the lever 17 loosely passes through an opening formed in the bracket 16 and is retained by a pair of pins 18 (only one is shown in FIG. 2), and a stop 19 having a generally L-shaped form is provided to restrict the movement of the lever 17 both in the vertical and horizontal directions or in directions opposite to the directions of arrows Q and R shown in FIG. 2. When the lever 17 is moved in the direction of arrow Q the lock valve 15 of the gas spring 13 is actuated and when the lever 17 is operated in the direction of arrow R a valve actuating member 20 of a lock valve 22 of a gas spring 21 is actuated. The gas spring 21 is provided in the leg portion 2 to adjust the height thereof.

The leg portion 2 comprises, as shown in FIG. 3, four legs 23 extending in four directions and having casters 24 on the lower sides thereof, a base 25 connecting the legs 23 with each other, the gas spring 21 mounted on the base 25, the supporting arm 14 secured to the upper end of the gas spring 21, horizontally projecting beams 27 secured to the upper end of the gas spring 21 and projecting in direction transverse to the supporting arm 14, rails 5 being secured respective of the outer ends of the beams 27 and 27, and reinforcing members 28 and 29 connecting respective ends of the rails 5. Each rail 5 is formed of a U-shaped channel steel member bent into a circular arc shape having a specified radius around a center P (FIG. 1) so that circular arc surfaces are defined on the upper and lower walls of each rail 5. Preferably, the width W of a groove 5*a* of the rail 5, or the distance between the upper and lower arcuate surfaces thereof, is slightly larger than the outer diameter of rollers 6 received therein so that the rollers 6 can rotatably move along the rail 5 and vertical play therebetween is as little as possible. It will be noted that a recessed portion 30 is formed in the reinforcing member 29 to avoid interference with the gas spring 13.

In utilizing the chair, the user of the chair seats on the seat 3 and operates the lever 17 in the direction of arrow Q to actuate the lock valve 15. The locking of the gas spring 13 is released and the seat portion 1 of the chair angularly moves in the arrow A or arrow B direction according to contracting or extending characteristics of the gas spring 13. By applying a relatively small force, the seat portion will angularly move against the contracting or extending force of the gas spring, thus, the user of the chair can rockingly move back and forth with the seat portion or can tilt the seat portion to any desired angular position. When the lever 17 is returned to its original position, the gas spring 13 is locked and the seat portion maintains its new position. When the gas spring is of the contracting type, the tilting movement in the direction of arrow B can be performed by leaning on the back portion 4, and when the gas spring 13 is of the extending type the tilting movement in the direction of arrow A can be performed by the user separating from the back portion 4 and extending his knees. The height of the seat portion 1 can be adjusted by operating the lever 17 in the direction of arrow R and releasing the lever 17 at a suitable height. Preferably, the gas spring 21 is of the extending type and the force of the gas spring can raise the seat portion 1 when the user is not seated on the seat portion 1 and can be overcome by the weight of the user seated on the seat portion 1.

In this embodiment, the rollers 6 are mounted on the seat portion 1 and the circular arc surface of rails 5 are defined on members secured to the leg portion, however, the rails 5 may be mounted on the seat portion 1 with the rollers 6 mounted on the leg portion.

Figure 4:
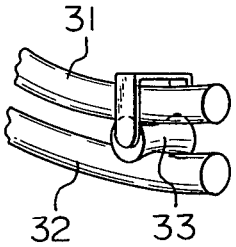
FIG. 4 is a fragmentary perspective view showing a modified form of rail and roller of FIG. 2.

FIG. 4 shows a modified form of rail and rollers wherein a pair of circular arc shaped circular rods 31 and 32 define the circular arc surfaces, for guiding therebetween rollers 33 having a cross-section corresponding to a space defined between the rods 31 and 32. Namely, the diameter of the opposite end portions of roller 33 is larger than the diameter of the central portion thereof. The rails 31 and 32 are secured to, e.g., the leg portion 2 and the rollers 33 (only one are shown in FIG. 4) is rotatably mounted on, e.g., the seat portion 1.

In the embodiment of FIGS. 2 and 3, the lock valve 22 of the gas spring 21 can be operated by the lever 17 only when the valve actuating member 20 is aligning with the lock valve 22 or when the supporting frame 7 is in a specified angular position with respect to the leg portion 2.

Figure 5:
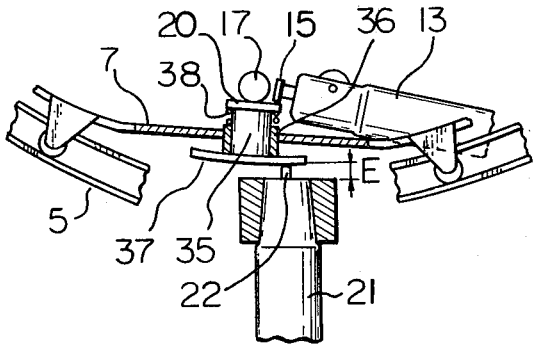
FIG. 5 is a partial sectional view of a modified form for enabling the operation of a height adjusting gas spring in a tilted condition.

The embodiment shown in FIG. 5 eliminates the shortcoming aforementioned and, in this embodiment, the valve actuating member 20 comprises a rod 35 slidably disposed in a sleeve 36 and having a curved plate 37 on the lower end of the rod 35. The sleeve 36 is secured to the supporting frame 7, and the rod 35 is biassed in the upward direction by a coil spring 38. When the member 20 is pushed by the lever 17, the curved plate 37 engages with the lock valve 22 to unlock the gas spring 21. Thus, the adjustment of the height can be performed at any desired tilted condition of the seat portion 1 with respect to the leg portion 2. The coil spring 38 may be omitted since the lock valve 22 of the gas spring 21 returns to its locked condition according to the pressure of the gas enclosed in the gas spring 21.

Figure 6:
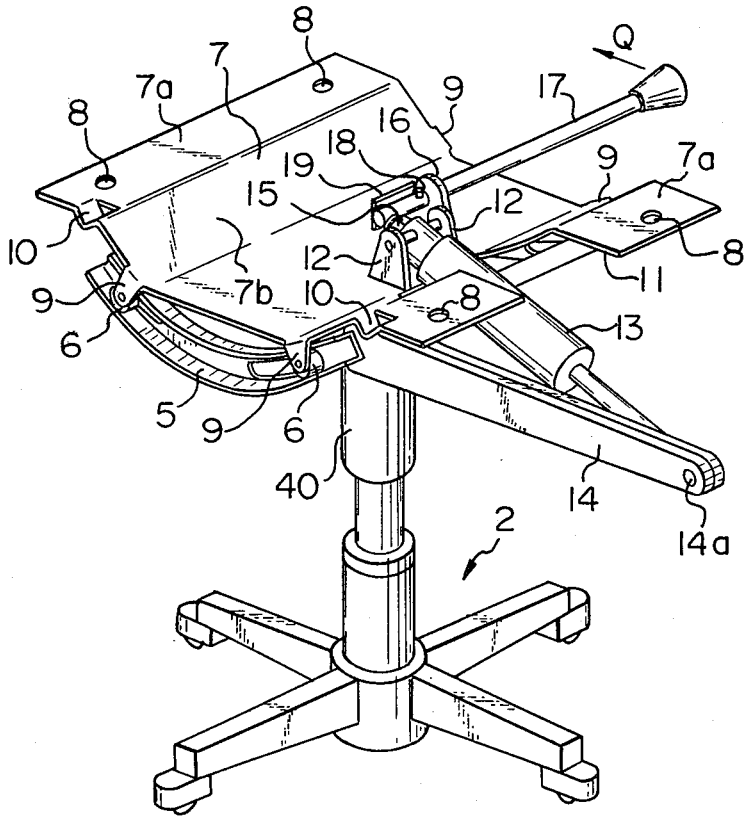
FIG. 6 is a perspective view similar to FIG. 2 but showing a second embodiment of the invention.
Figure 7:
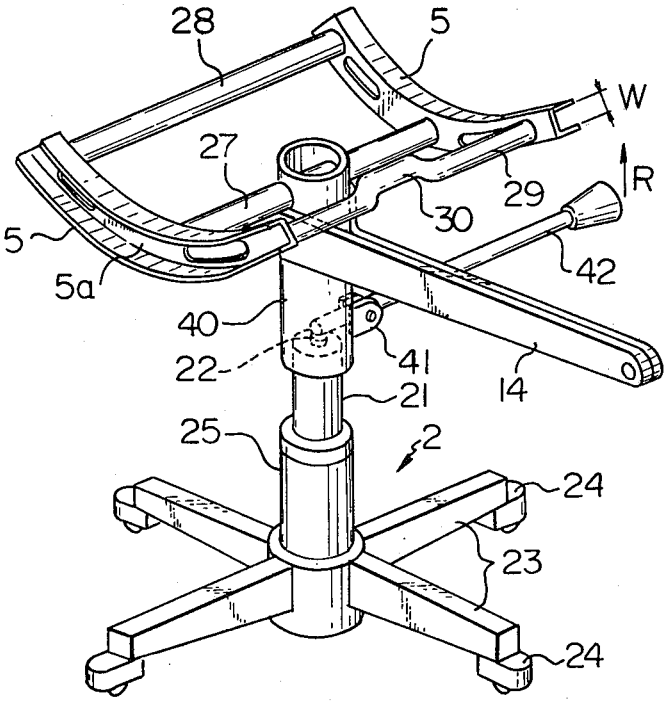
FIG. 7 is a perspective view of the leg portion of FIG. 6.

The second embodiment shown in FIGS. 6 and 7 is generally similar to the embodiment of FIGS. 1–3 and corresponding numerals have been applied to corresponding parts, the description of which is omitted.

In this embodiment, the lever 17 for releasing the locking device is adapted to move only in the direction of arrow Q and is solely provided for changing the tilting angle of the seat portion with respect to the leg portion 2. For changing the height of the leg portion 2, there is provided a lever 42 separate from the lever 17. The lever 42 is pivotally mounted on brackets 41 which are secured to a cylindrical member 40 to project in the horizontal direction therefrom. The cylindrical member 40 is secured to the upper end of the gas spring 21 and a beam 27 similar to the beams 27 of FIG. 3 is secured to the upper end of the cylindrical member 40 to support thereon the circular arc shaped rails 5 and reinforcing members 28 and 29.

The construction and operation of the embodiment of FIGS. 6 and 7 are similar to the embodiment of FIGS. 1–3.

It will be noted that the supporting arm 14 for supporting one end of the gas spring 13 is provided on the side of the back 4 of the seat portion 1 when the gas spring 13 is of the extending type and is provided on the side opposite to the back 4 when the gas spring is of the contracting type.

Since the lever 42 for adjusting the height of the chair is provided separately from the lever 17 changing the tilting angle of the seat, the construction can be simplified and it is possible to prevent mistakes in operation.

Figure 8:
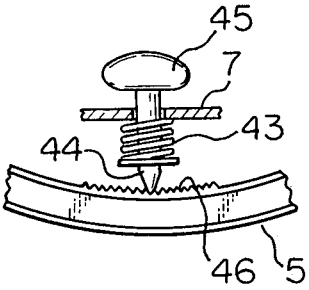
FIG. 8 is a partial side view showing a modified form of locking mechanism.

In the aforesaid embodiments, the gas spring 13 has been provided between the leg portion and the seat portion, however, the gas spring 13 may be replaced by a conventional coil spring or by a gas spring without having any locking devices. In such case any suitable locking device is preferably provided between the leg portion and the seat portion such as shown in FIG. 8. In FIG. 8, a locking member 44 is mounted on the supporting frame 7 secured to the seat portion (not shown) and is biassed toward the upper surface of the rail 5 which is secured to the leg portion (not shown) by a coil spring 43. A plurality of teeth 46 is formed on the upper surface of the rail 5 so as to adjustably engage with the tip end of the locking member 44. A knob 45 is formed on the locking member 44.

Figure 9:
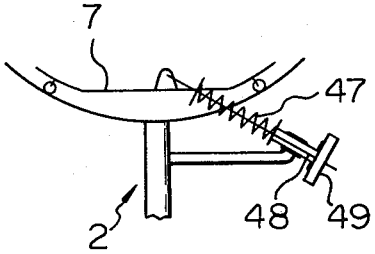
FIG. 9 is a partial schematic view showing a modified form of the spring.

FIG. 9 shows a device for adjusting the spring force of a conventional coil spring 47 which biasses the seat portion in one direction with respect to the leg portion. In FIG. 9, a rod 48 is pivotally connected to the seat portion and is connected to the left or the upper end of the coil spring 47 and freely extends through the coil spring 47 and through a hollow nut 49. The nut 49 is screw threadingly and pivotally connected to the leg portion. Any suitable device may be provided between the hollow nut 49 and the rod 48 to lock the tilting or rocking movement of the seat portion.

Figure 10:
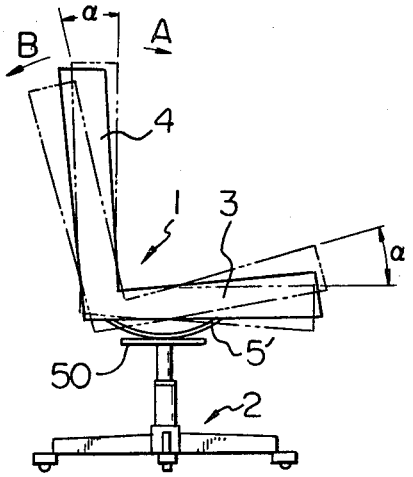
FIG. 10 is an explanatory view showing a third embodiment of the invention.
Figure 11:
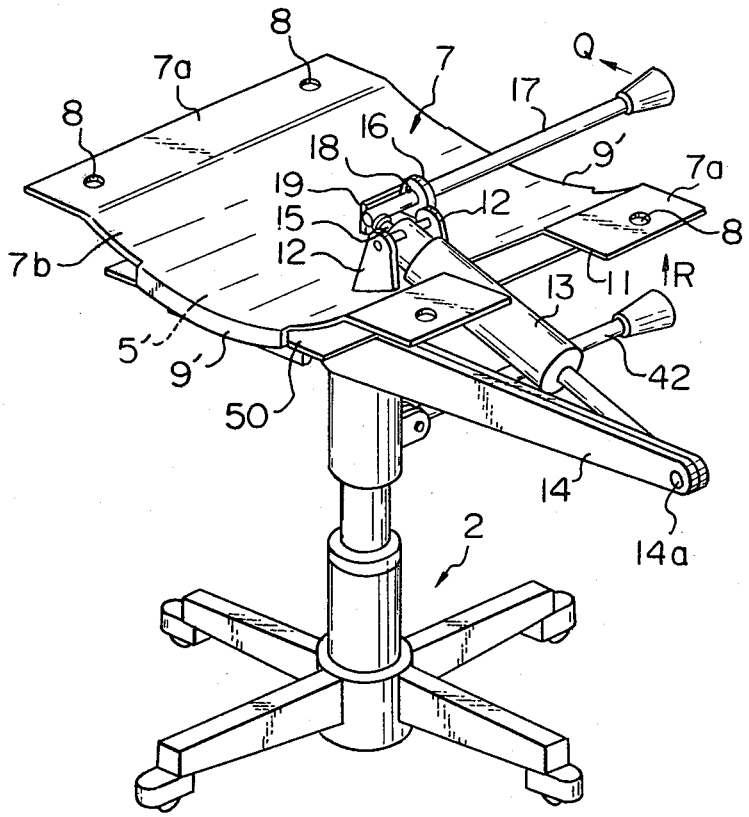
FIG. 11 is a perspective view similar to FIGS. 2 and 6 but showing the third embodiment.
Figure 12:
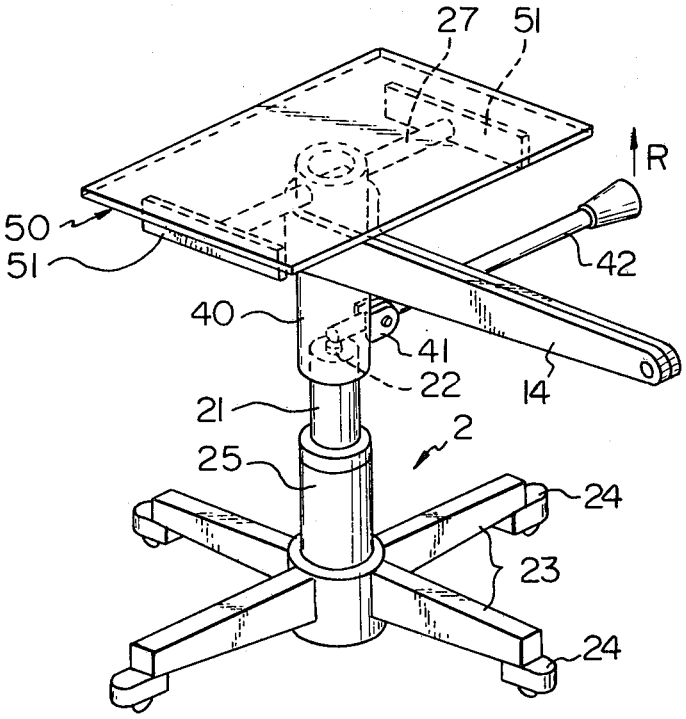
FIG. 12 is a perspective view of the leg portion of FIG. 11.

FIGS. 10–12 show a third embodiment of the invention which is generally similar to the embodiments of FIGS. 1–3 and FIGS. 6 and 7 and, parts corresponding to those embodiments are denoted by the same numerals and, therefore, detailed descriptions therefor are omitted.

As shown in FIGS. 10 and 11, a circular arc shaped surface 5' is formed on the lower surface of a supporting frame 7 which is secured to a seat portion 1. The supporting frame 7 is rockingly mounted on a flat plate 50 which is secured to leg portion 2. To prevent the supporting frame 7 from the movement in the sidewise directions, downwardly extending flanges 9' are formed on the opposite side edges of the supporting frame 7. The arrangement of levers 17 and 42 for releasing the lock valves 15 and 22 of gas springs 13 and 21 is similar to the embodiment of FIGS. 6 and 7. The flat plate 50 is secured to members 51 which are supported by a beam 27 secured to the upper end of a cylindrical member 40. The upper surface of the plate 50 engages with the arc shaped surface 5' of the supporting frame 7.

The operation of the third embodiment is similar to that of the first and second embodiments.

As described heretofore, the rockingly movable chair according to the invention has a very simple construction and, it is possible to adjust the tilting angle of the seat portion with respect to the leg portion at any desired angle and, therefore, the user can sit on the chair for a long period of time with a minimum of fatigue and, it is possible to rockingly move the chair reciprocably in back and forth directions, thereby relieving the fatigue.

What is claimed is:

1. A rockingly movable chair comprising:

a leg portion;

a seat portion supported on said leg portion;

one of said leg portion and said seat portion having a circular arc surface;

the other of said leg portion and said seat portion having an element mounted for displacement along said circular arc surface such that said seat portion is rockably movable with respect to said leg portion;

first gas spring means, connected between said leg portion and said seat portion, for movement biasing said seat portion in one rocking direction during rocking movement thereof;

second gas spring means for movement raising and lowering selectively the height of said leg portion;

each of said first and second gas spring means including a respective lock movable between a locking position preventing movement of the respective gas spring means and a releasing position allowing movement of the respective gas spring means; and actuating means for operating independently and selectively said locks of said first and second gas springs for selective and independent movement between said locking and releasing positions thereof, said actuating means comprising a single operating lever movably mounted on said seat portion, said lever having a portion for operating one of said locks and an arcuate member for operating the other of said locks.

2. A chair as claimed in claim 1, wherein said arcuate member operates said lock of said second gas spring means, and said arcuate member has a dimension capable of operating said lock of said second gas spring means in any relative rocking position of said seat portion with respect to said leg portion.

3. A chair as claimed in claim 1, wherein said lever is movable in two perpendicularly intersecting planes to operate separately said two locks.

4. A chair as claimed in claim 1, wherein said seat portion comprises a seat and a back fixed with respect to said seat.

5. A chair as claimed in claim 4, wherein said seat portion further comprises a frame attached to said seat, said lever being mounted on said frame.

6. A chair as claimed in claim 5, wherein said circular arc surface is on said leg portion, said frame has an intermediate portion, and said element comprises rollers in rolling contact with said circular arc surface.

7. A chair as claimed in claim 1, wherein said circular arc surface is defined by a pair of spaced circular rods having an arcuate configuration, and said element comprises rollers guided between said pair of rods.

8. A chair as claimed in claim 1, wherein said circular arc surface is defined by a pair of arcuate rails, and said element comprises rollers guided between said rails.

9. A chair as claimed in claim 1, wherein said seat portion comprises a frame, said lever is mounted on said frame, said actuating means further comprises a rod slidably extending through said frame, a first end of said rod is operated by said lever to extend said rod through said frame, said arcuate member is connected to a second end of said rod, and said arcuate member has a dimension sufficient to operate said lock of said second gas spring means in any possible relative rocking position of said frame with respect to said leg portion.

* * * * *